US005943771A

United States Patent [19]

Schmitt

[11] Patent Number: 5,943,771

[45] Date of Patent: Aug. 31, 1999

[54] METHOD OF MAKING A CATALYTIC CONVERTER FOR USE IN AN INTERNAL COMBUSTION ENGINE

[75] Inventor: Paul S. Schmitt, Big Flats, N.Y.

[73] Assignee: Corning Incorporated, Corning, N.Y.

[21] Appl. No.: 09/013,976

[22] Filed: Jan. 27, 1998

Related U.S. Application Data

[60] Provisional application No. 60/037,479, Feb. 3, 1997.

[51] Int. Cl.[6] ..... B23P 15/00

[52] U.S. Cl. ..... 29/890; 29/523

[58] Field of Search ..... 29/890, 523; 422/179

[56] References Cited

U.S. PATENT DOCUMENTS

| | | | |
|---|---|---|---|
| 3,441,382 | 4/1969 | Keith et al. . | |
| 3,958,312 | 5/1976 | Weaving et al. . | |
| 4,093,423 | 6/1978 | Neumann . | |
| 4,239,733 | 12/1980 | Foster et al. . | |
| 4,750,251 | 6/1988 | Motley et al. . | |
| 4,782,661 | 11/1988 | Motley et al. . | |
| 4,925,634 | 5/1990 | Yokokoji et al. . | |
| 4,985,212 | 1/1991 | Kawakami et al. . | |
| 5,055,274 | 10/1991 | Abbott | 422/179 |
| 5,082,479 | 1/1992 | Miller . | |
| 5,273,724 | 12/1993 | Bos . | |
| 5,666,726 | 9/1997 | Robinson et al. | 29/890 |
| 5,729,902 | 3/1998 | Wieres et al. | 29/890 |

FOREIGN PATENT DOCUMENTS

| | | |
|---|---|---|
| 0 299 626 | 1/1989 | European Pat. Off. . |
| 9702414 | 1/1997 | WIPO . |

OTHER PUBLICATIONS

Nonnenmann M: "Metal Supports for Exhaust Gas Catalysts", SAE Transactions, vol. 94, 1985, pp. 1.814–1.812, XP000677863.

*Primary Examiner*—Irene Cuda
*Attorney, Agent, or Firm*—Timothy M. Schaeberle

[57] ABSTRACT

A method of manufacturing a catalytic converter having a non-round monolithic ceramic substrate comprising the steps of: wrapping a non-round monolithic ceramic substrate in a sufficient amount of the supporting mat material whereby the substrate peripheral surface is substantially covered; inserting the wrapped substrate into a metal shell which substantially surrounds the wrapped substrate; placing at least one force redistribution plug on the peripheral surface of the metal shell and compressively closing the metal shell around the substrate; and securing the metal shell to provide a gas tight seal and to hold the compressive stress.

9 Claims, 9 Drawing Sheets

METHOD OF MAKING A CATALYTIC CONVERTER FOR USE IN AN INTERNAL COMBUSTION ENGINE

This application claims the benefit of U.S. Provisional Application No. 60/037,479, filed Feb. 3, 1997, entitled Method of Making a Catalytic Converter for Use in an Internal Combustion Engine by Paul S. Schmitt.

BACKGROUND OF THE INVENTION

1. Field of the Invention

The invention relates to catalytic converters for purifying exhaust gases, and more particularly to method for forming catalytic converters having non-round honeycomb substrates wherein the method involves utilizing force distribution plugs which are designed to result in uniform compressive forces being exerted on the encircling mat and the honeycomb substrate.

2. Description of the Related Art

As is well known, the purification of exhaust gases from internal combustion engines, particularly in motor vehicles, is generally achieved by an exhaust gas purification system in which a ceramic element having a honeycomb cell structure acts a catalyst carrier. More precisely, this honeycomb cell structure is covered with a catalyst which contains a precious metal which functions, in the presence of $O_2$, to convert noxious components of the exhaust gas, such as HC and CO, to $CO_2$ and $H_2O$. The honeycomb cell structure is housed within a gas-tight, sheet metal or cast-metal heat resistant housing or can or shell.

Honeycomb structures currently employed are typically comprised of a ceramic material such as cordierite; a brittle material exhibiting limited mechanical strength. For this reason, catalytic converters in use today, typically include a supporting mat which is wrapped around the periphery of the honeycomb. This resilient material, which distributes any compressive forces uniformly on the ceramic, typically expands as the temperature increases. This being the case, the compressive supporting pressure on the honeycomb therefore increases at elevated temperatures, and in some degree compensates for the thermal expansion of the outer metal shell. Since the metal shell expands more than the enclosed ceramic honeycomb, this mat expansion with temperature rise prevents the honeycomb from becoming loose in the shell.

There are known in the art various methods of fabricating catalytic converters as described above, including inserting tight-fitting mat-wrapped honeycombs into tubular shells (see, for example U.S. Pat. No. 4,093,423 (Neumann)), as well as utilizing two metal shell halves which are closed around a mat-wrapped honeycomb and thereafter welded together; see for example U.S. Pat. No. 5,273,724 (Bos). Another such method of fabrication, commonly referred to as the "tourniquet wrap" method involves forming a rectangular flat sheet metal piece into a cylindrical body having a lap joint. A mat-wrapped honeycomb is loosely inserted into the cylindrical metal can and the combined assembly is pulled together to form the desired mat compression. Thereafter, the lap joint is welded together thereby holding the can at the desired compression while at the same time preventing gas leakage; see for Example U.S. Pat No. 5,082,479 (Miller).

Although round substrates have some advantages in terms of uniform mounting and fundamental strength, the available space in an under-car applications has lead to the use of non-round shapes which are capable of providing sufficient catalyst surface area within the limited under-car space available. An inherent deficiency of the aforementioned formation techniques when used for non-round, oval or similar, shapes is uneven or non-uniform compressive closing of the encircling mat. Specifically, the mat portion located along the substrate's flatter side, i.e., along the minor axis, is less compressed than those rounder, smaller end portions of the substrate, i.e., along the major axis. On the one hand, the inadequate compression of the flatter sides results in an axial retention, i.e., the restraining forces which hold the substrate in place, which is decidedly lower than desirable and thus decreases product durability. On the other hand, the over-compressed small ends, areas where the mat gap is the small, lead to an increased risk of substrate failure due to point loading and localized compressive failure of the honeycomb structure, i.e., crushing of the brittle honeycomb structure.

This non-uniform compression problem has been addressed by various means including the use of deformed metal cans which provide less clearance along the flat sides, as well as the use of ribbing in the configuration which increases the rigidity of the can in the flatter areas. Although these methods alleviate the over/under compression problem somewhat, the search for better and simpler solutions to uniform oval canning has continued.

SUMMARY OF THE INVENTION

It is therefore an objective of the present invention to overcome the problems and shortcomings inherent in current methods of forming non-round catalytic converters; i.e., the resultant non-uniform compression. In other words, the formation of non-round catalytic converters which exhibit a substantially uniform compressive load upon the encircling mat and the honeycomb structure thereby avoiding localized compressive failure and inadequate axial retention of the honeycomb substrate.

This objective, as well as other objectives which will become apparent in the discussion that follows, are achieved, in accordance with the present invention by utilizing force redistribution plugs, in the compressive closing formation, which effectively results in uniform compression of the honeycomb substrate. In general, the method of manufacturing these catalytic converters having non-round honeycomb substrates comprises the following steps: (1) wrapping a non-round monolithic ceramic substrate in a sufficient amount of the supporting mat material whereby the substrate's peripheral surface is substantially covered; (2) inserting the wrapped substrate into a metal shell which substantially surrounds the wrapped substrate; (3) placing at least one force redistribution plug on the peripheral surface of the metal shell and compressively closing the metal shell around the substrate; and, (4) securing the metal shell to provide a gas tight seal and to hold the compressive stress.

The so-formed catalytic converter disclosed herein comprises the following components: (1) a non-round monolithic ceramic substrate having an aspect ratio of approximately greater than 1.05 and having a peripheral surface encircled by a sufficient amount of supporting mat material whereby the peripheral surface is essentially covered; and, (2) a non-round cylindrical metal shell which encircles and exerts a substantially uniform compressive force on the wrapped substrate.

DETAILED DESCRIPTION OF THE INVENTION

Figure 1:
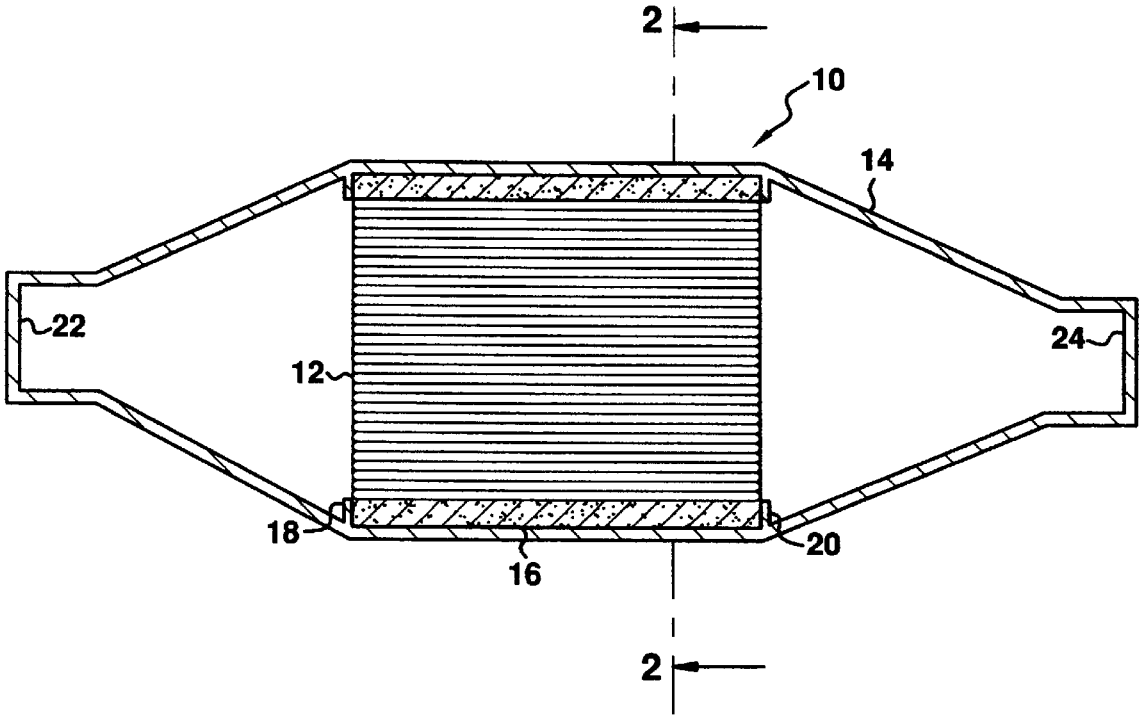
FIGS. 1 and 2 illustrate one embodiment of the present invention, FIG. 1 being a schematic longitudinal sectional view of a catalytic converter, FIG. 2 being a cross-sectional view of this catalytic converter illustrating the uniformity of the encircling mat gap.
Figure 2:
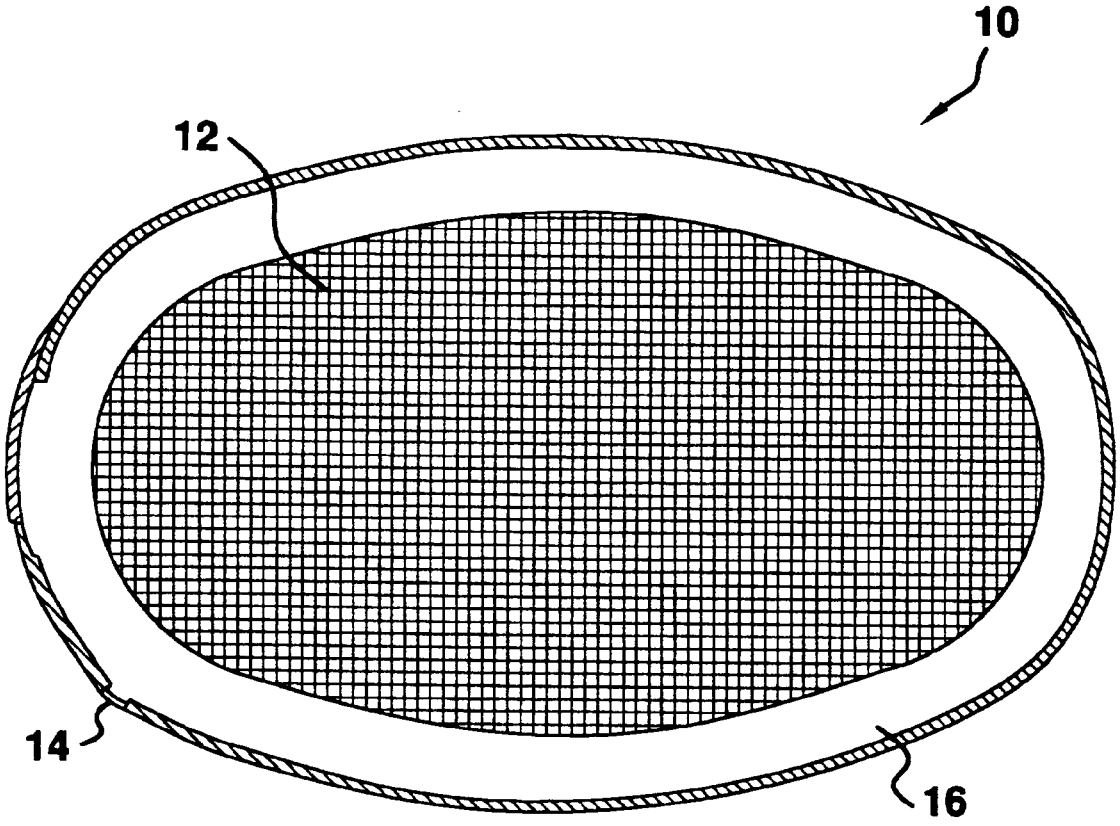

Referring now to FIGS. 1 and 2, illustrated therein is a catalytic converter for purifying exhaust gases from an internal combustion. The catalytic converter 10 comprises a non-round (oval in this embodiment) cylindrical ceramic honeycomb substrate 12, having an aspect ratio of approximately greater than 1.05, which functions as the catalyst structure or carrier, and a metallic shell 14 enclosing the same. Honeycomb 12 is formed by extruding a ceramic material such as cordierite, and is supported on the metal shell or can 14 by means of ceramic fiber mat or wire mesh 16, which encircles the substrate and functions as a shock absorber. Mat 16, having a width substantially equal to the length of the oval honeycomb 12, is interposed between the honeycomb 12 and the metal shell 14 so as to be wound around honeycomb 14. The mat, set by proper heating, presses the outer periphery of the honeycomb thereby fixing it against a drag caused by the gas flow. Abutting pieces 18 and 20, which may be optionally included in the catalytic converter design, protrude from the inner periphery of metal shell 14, whereby fiber mat 16 is prevented from being longitudinally dislocated with respect to metal shell 14 by the drag from the gas flow or associated vibrational accelerations. Additionally, shell 14 has inlet and outlet ports 22 and 24. Gas introduced through inlet port flows through individual cells of honeycomb 12 and out through outlet port 24.

Oval honeycomb 12, has square cells, although the cells of the honeycomb may have shapes other than square, including triangular, rectangular and the like. In consideration of the tooling costs for extrusion molding or the like, however the cells are generally square in shape.

Figure 3:
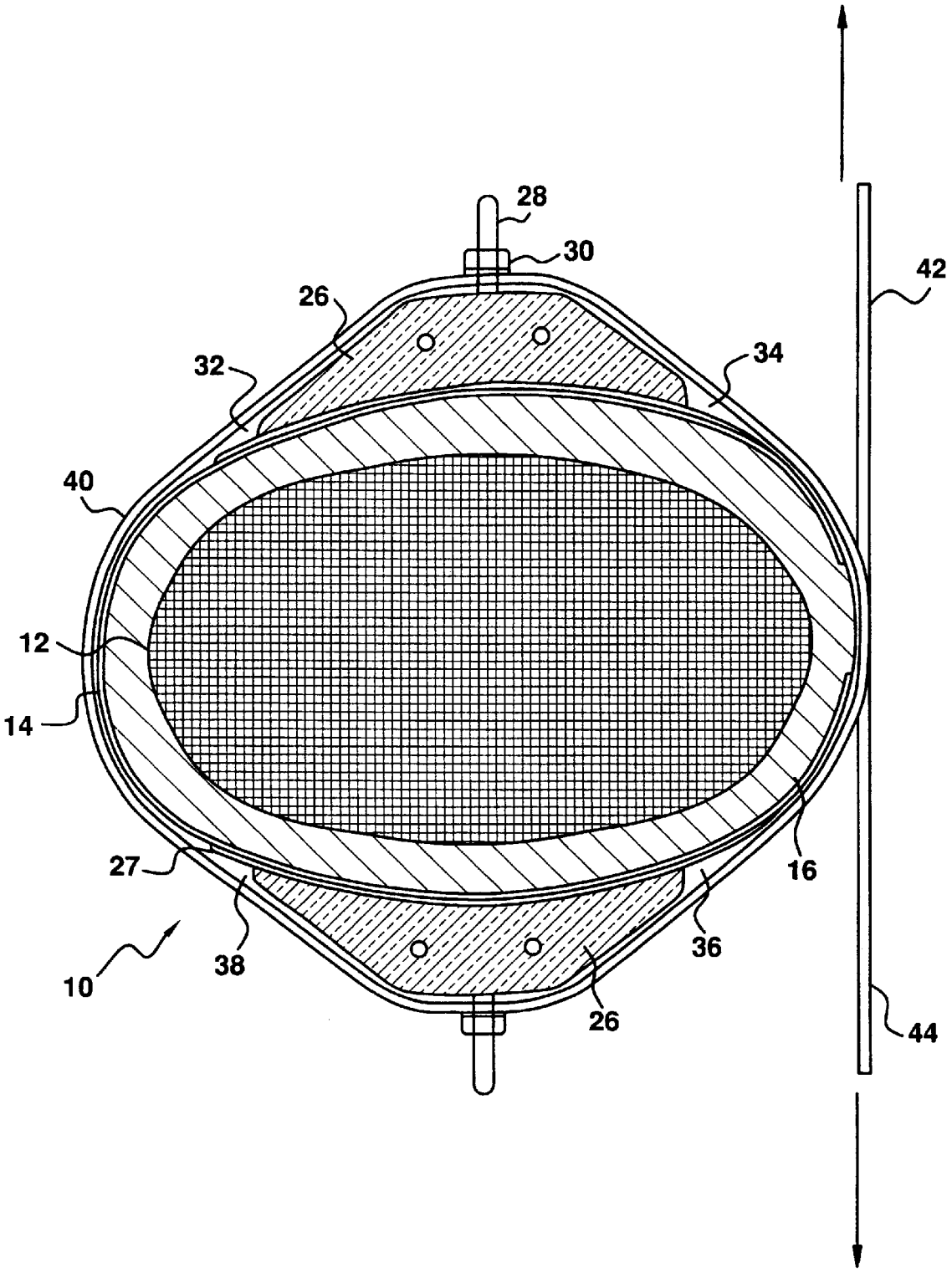
FIG. 3 is cross-sectional view of one embodiment of the inventive compressive forming method incorporating force redistribution plugs for forming the non-round substrate-containing catalytic converter.

FIG. 3 illustrates one embodiment of fabrication of the catalytic converter shown in FIGS. 1 and 2. A non-round monolithic ceramic substrate 12 is wrapped in a sufficient amount of the supporting mat material 16 whereby the substrate's 12 peripheral surface is substantially covered. Mat 16 comprises a formed ceramic fiber material, either a simple non-expanding ceramic material, an intumescent material, e.g., one which contains a vermiculite component that expands with heating to maintain firm compression when the outer steel expands outward from the ceramic monolith, as well as mats which include a combination of both. Acceptable non-expanding ceramic fiber material include ceramic materials such as those sold under the trademarks "NEXTEL" and SAFFIL" by the "3M" Company, Minneapolis, Minn. or those sold under the trademark "FIBERFRAX" and CC-MAX by the Unifrax Co., Niagara Falls, N.Y. Acceptable intumescent ceramic include ceramic materials such those sold under the trademark "INTERAM" by the "3M" Company, Minneapolis, Minn., as well as those intumescents which are also sold under the aforementioned "FIBERFRAX" trademark.

The wrapped substrate 12 is thereafter inserted into a metal shell 14 which substantially surrounds the wrapped substrate 12. Suitable materials for the shell 14 comprise any material which is capable of resisting under-car salt, temperature and corrosion; ferritic stainless steels including grades SS-409, SS-439, and more recently SS-441 are however, generally preferred. The choice of material depends on the type of gas, the maximum temperature and the like.

At least one force redistribution plug 26 is placed on the peripheral surface of the metal shell 14. In the embodiment of FIG. 3, force distribution plugs 26 are located on each of the opposing surfaces of the metal shell 14 along the minor axis of the converter and secured; specifically, force distribution plugs 26 are secured thereto by a threaded bolt 28 and nut 30. The function of the plugs 26 is, in effect, to transform the compressive surface of the wrapped substrate 12 from that of an oval to a much more round-like shape. In other words, the plugs 26 function to increase the compressive force on the flat sides along the minor axis and reduce the compressive forces on the smaller rounder sides along the major axis; i.e., a redistribution of the compressive force whereby the compressive forces exerted on the substrate 12 are substantially uniform along the periphery. As a result, the variability of the mat gap and gap bulk density is reduced over that which is typical for oval substrates, having an aspect ratio (major to minor axis) greater than about 1.05, which are compressively canned without the use of force distribution plugs.

Suitable materials for the force distribution plugs 26 include deformable materials selected from the group consisting of urethane, epoxy resin, neoprene and wood. The plugs can be formed from pre-formed blocks of the chosen material which is thereafter shaped by any known method (e.g., water-jet cutting), to the predetermined plug shape.

Additionally, the plugs can be fabricated by disposing a castable mixture of the aforementioned plug material within a mold of the predetermined plug shape and molding the so-formed plugs to the desired shape.

In one embodiment, inserted between the force distribution plugs and the metal shell is a lightweight, low-friction material layer 27, e.g., lightweight metal stock, which functions to allow the plug to easily slide along the metal shell during the compression closing of the metal shell around the substrate; e.g. a thin galvanized, iron sheet layer conforming to the shape of the inner block of material.

In another embodiment the plug itself is comprised of several layers of flat metal stock forming a leaf spring configuration which conforms predetermined shape of the plug.

For those oval honeycombs which exhibit a large aspect ratio; i.e., greater than 1.2, force distribution shims can be incorporated into the four diagonal regions 32, 34, 36, and 38 , around the periphery of the wrapped substrate 12 of the converter configuration so as to further increase the mat gap/compression uniformity.

In one embodiment as illustrated in FIG. 3 a tourniquet wrap method of compressively closing is employed to form the catalytic converter. Specifically, the metal shell of the converter is wrapped in a metallic casing 40 which surrounds the periphery of the metal shell 14 and includes an upper 42 and lower strap 44 end which are pulled in opposite directions, as indicated by the arrows, to compressively close the metal shell 14 around the substrate 12 to the desired target mat compression. Thereafter, the metal shell 14 is secured to provide a gas tight seal and to hold the compressive stress and the strap is thereafter removed; preferably the method of securing involves welding the ends of the metal shell together.

Other methods of compressively closing the metal shell to form the catalytic converter include: (1) the use of metal shell die halves, exhibiting substantially the desired converter exterior shape, which are compressively closed together (e.g., "clam shell closure"); and, (2) and collet closure.

EXAMPLES

Oval Formed with Force Distribution Plugs

An oval substrate exhibiting a major axis diameter of 146.8 mm and a minor axis diameter of 77 mm (an aspect ratio of 1.91), was canned utilizing the tourniquet wrap style of canning detailed above. Specifically, the converter was compressively closed to a target mat compression of 1.07 g/cc. The force redistribution plugs utilized in the formation were comprised of cast urethane squeegee material having an 80 Durometer elasticity measure; the plugs were formed by water-jet cutting layers from ⅜" stock to the appropriate plug shape and thereafter stacking side-by-side and securing together with threaded plastic rods a sufficient number of the layers (16 in this embodiment) to form a force distribution plug which approximated the length of the substrate. A 20 gage galvanized iron-sheet liner conforming to the desired shape of the so-formed plug was placed between the plug and the metal shell.

The compressive closing additionally included the use of four rectangular force redistribution shims which were placed one each in the four diagonal regions around the periphery of the metal shell; specifically at the 30°, 150°, 210° and 330° locations. The 30°, and 330° shims were comprised of a ⅛" red, gasket-rubber material while the 150° and 210° shims were comprised of a 16 gage thick aluminum material.

The substrate mat was comprised of an intumescent ceramic material sold under the trademark "6200 INTERAM" by the "3M" Company, Minneapolis, Minn. while he metal shell was comprised of 1.2 mm thick ferritic stainless steel, grade SS-439.

Figure 4:
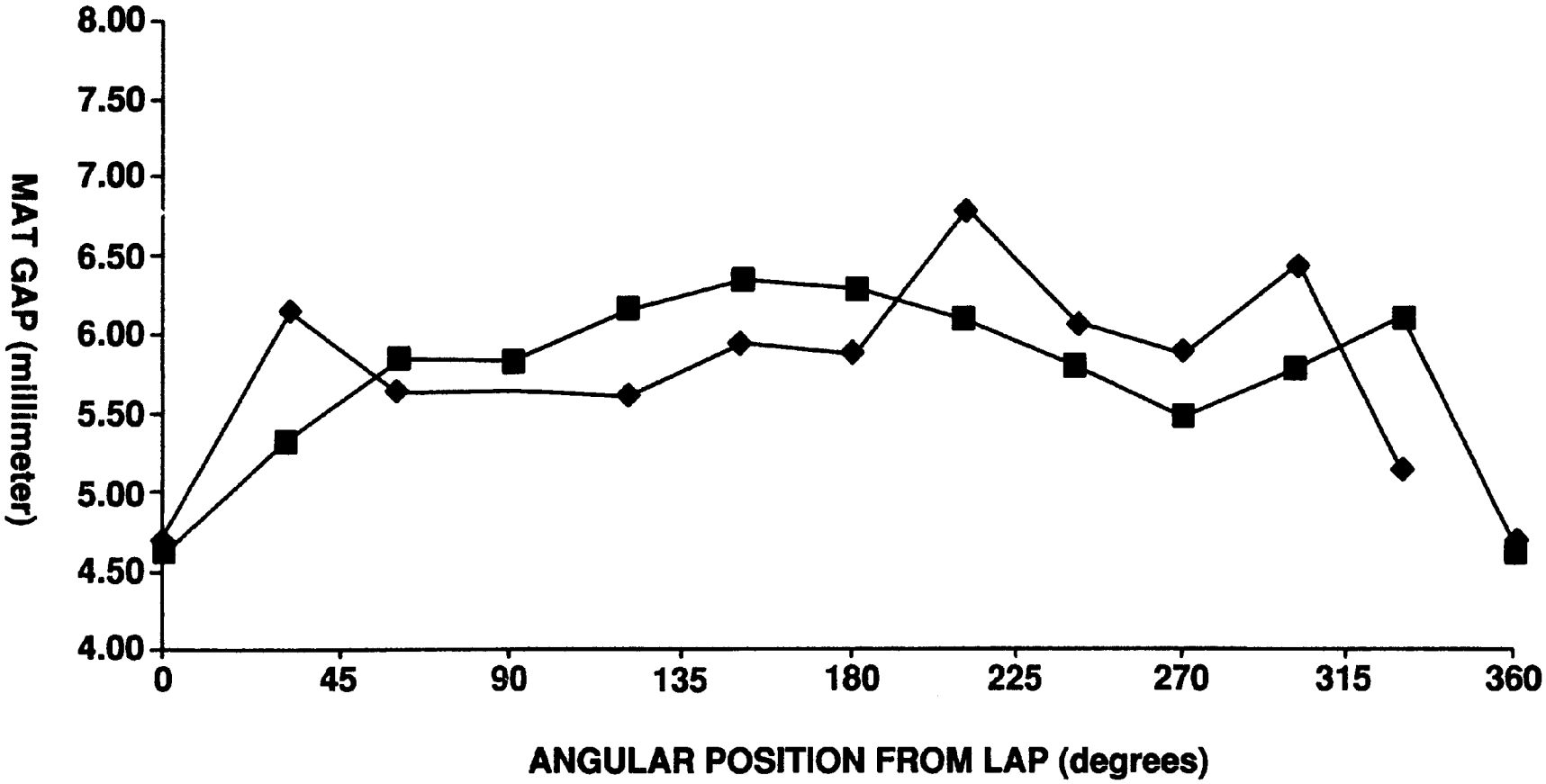
FIGS. 4 and 5 are graphs illustrating the improved gap bulk density and mat gap, respectively, of the non-round substrate-containing catalytic converters formed utilizing the inventive methods.
Figure 5:
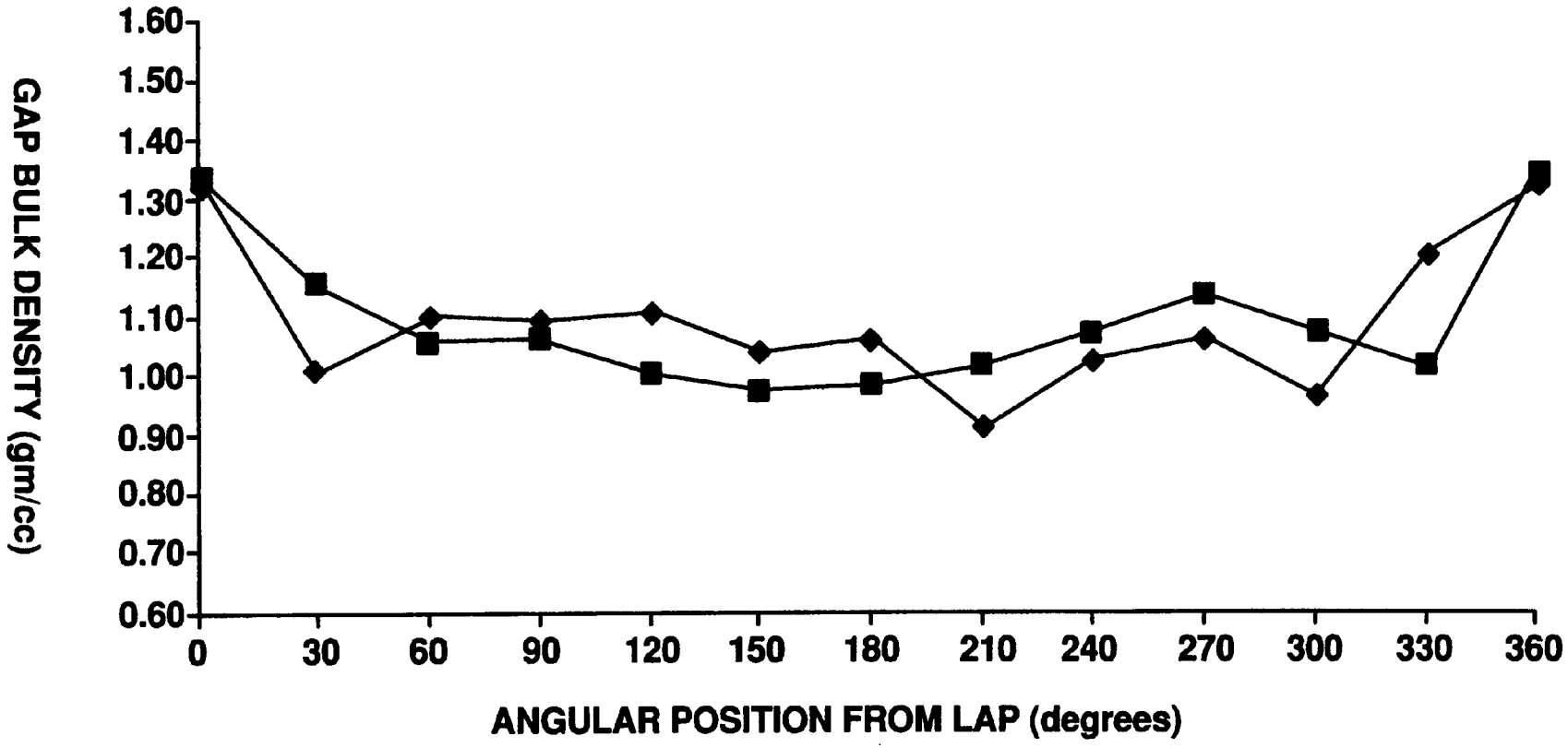

The so-formed catalytic converter's mat gap was measured at 8 equally spaced places at both ends. Mat gap measurements were plotted to form the FIG. 4 graph and utilized to generate gap bulk density measurements which were plotted to form FIG. 5; the gap density calculated by dividing the mat weight basis of 6200 g/m$^2$ by the each of the eight mat gap measurements. A review of both FIGS. reveals that so-formed catalytic converter has a mat gap and gap bulk density variability which is much improved over that which is typical for an oval substrate tourniquet wrap canned without redistribution plugs and, and which approaches the variability typically exhibited by round tourniquet canned substrates; see later examples.

Comparison Examples

Figure 6:
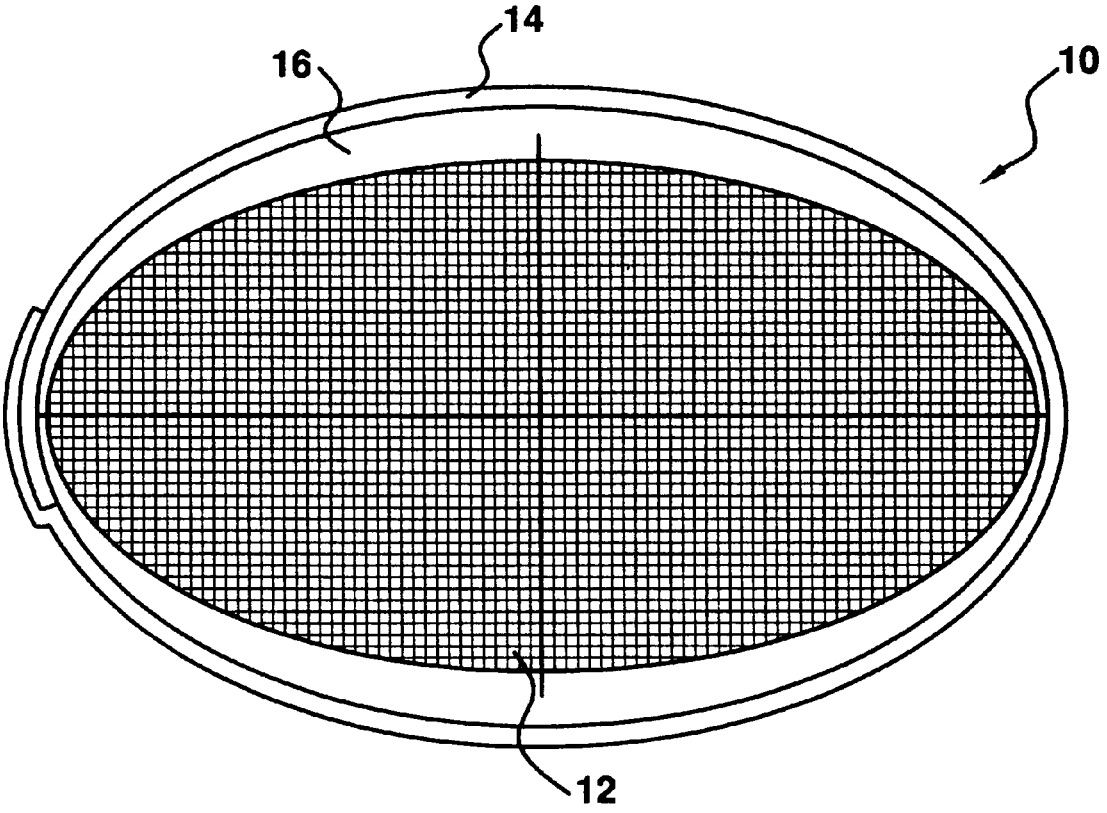
FIG. 6 illustrates the variable mat gap which is typical for non-round substrate-containing catalytic converters formed without utilizing force redistribution plugs.
Figure 7:
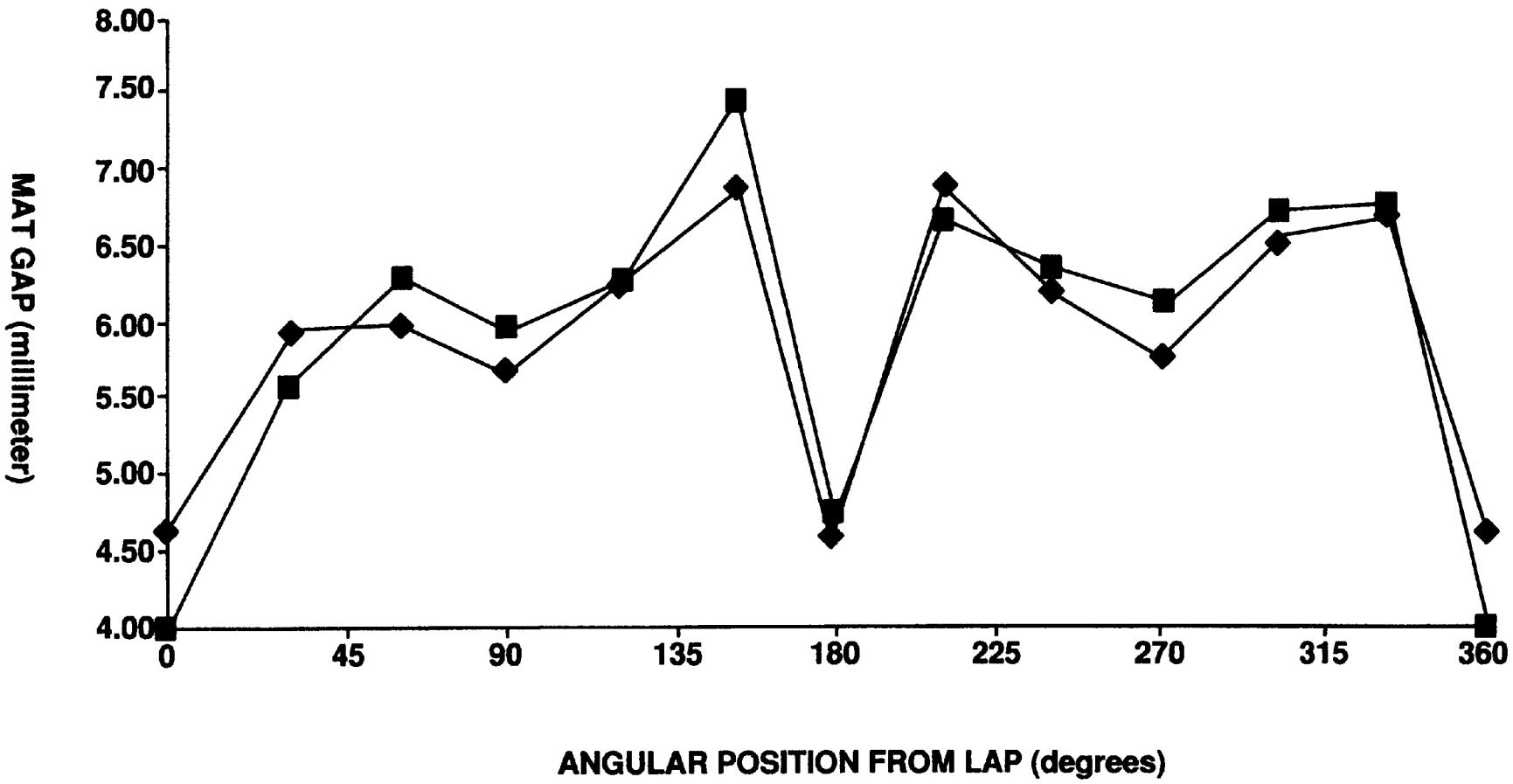
FIGS. 7 and 8 are graphs, for comparison, illustrating the gap bulk density and mat gap, respectively of non-round substrate-containing catalytic converters formed without utilizing force redistribution plugs.
Figure 8:
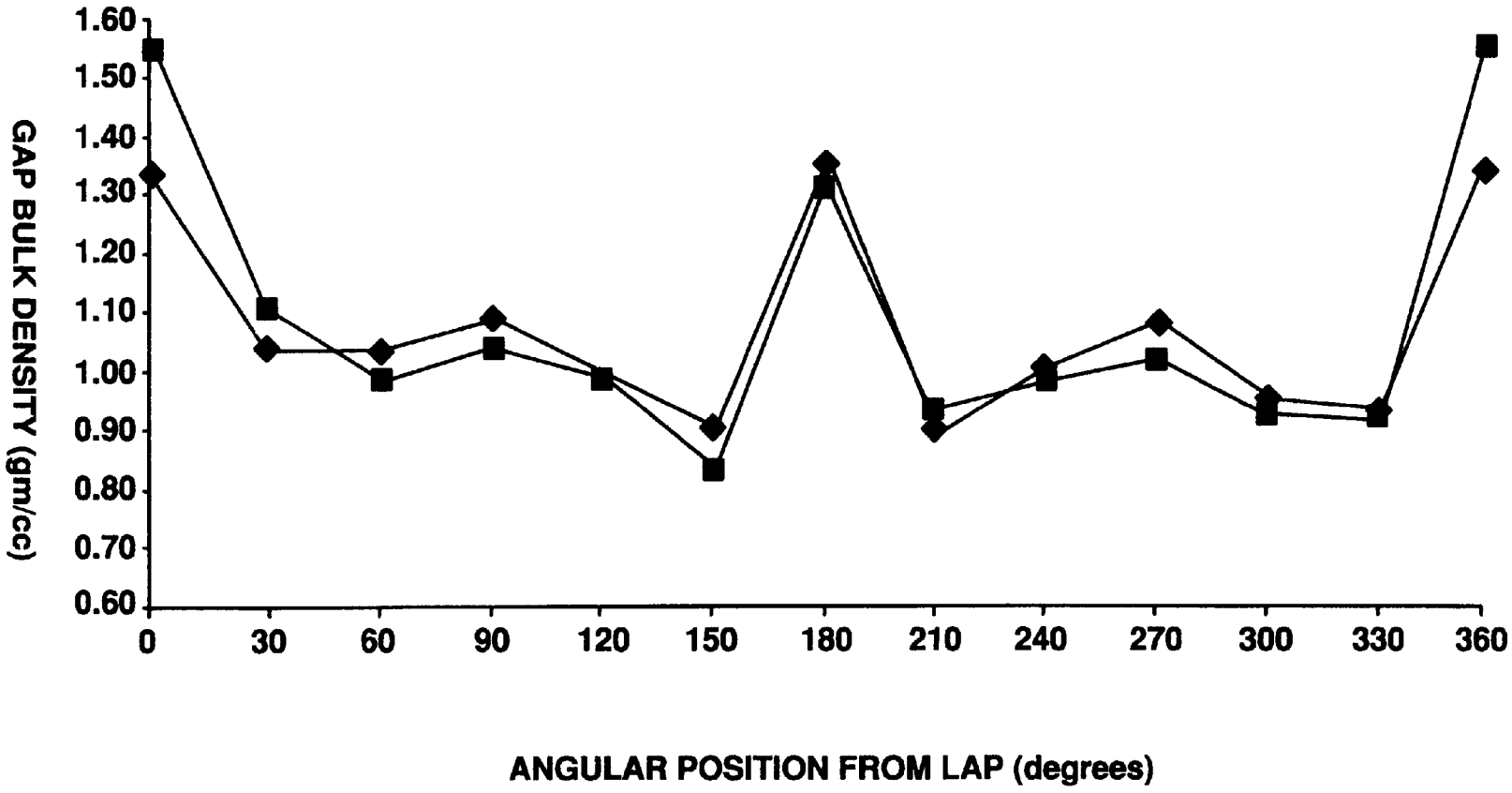

An oval honeycomb substrate sample exhibiting the same major and minor axis as the plugged oval above was canned using a same mat and metal shell materials and the same tourniquet style of closure as above; with the exception that the formation did not involve the use of force redistribution plugs or shims. The so-formed catalytic converter exhibited a formed, compressed configuration like that illustrated in FIG. 6; an undesirable non-uniform mat gap. The actual mat gap of the so-formed converter was measured at 8 equally spaced places at each end and then used to generate the FIG. 7 graph; the graph further illustrates the non-uniform nature of the mat gap seen in FIG. 6. As before, the gap measurements were used to calculate the gap bulk density of the converter, the results plotted to generate FIG. 8. An examination of the FIG. 8 reveals that certain regions are an over-compressed (>1.5 g/cc) and likely subject to breakage while other regions are under-compressed exhibiting a compression of less than 0.9 g/cc, which is known be highly likely to lead to gas erosion. Lastly, a comparison of FIGS. 4 and 5 with FIGS. 7 and 8 further reveals the increase in compression uniformity which results from the utilization of the inventive force distribution plugs.

A round honeycomb substrate sample exhibiting a diameter of 85.5 mm was canned using same mat and metal shell materials and the same tourniquet style of closure as above; no plugs or shims. As, before, mat gap was measured at eight equally spaced positions and used to generate the graph illustrated in FIG. 9.

Figure 9:
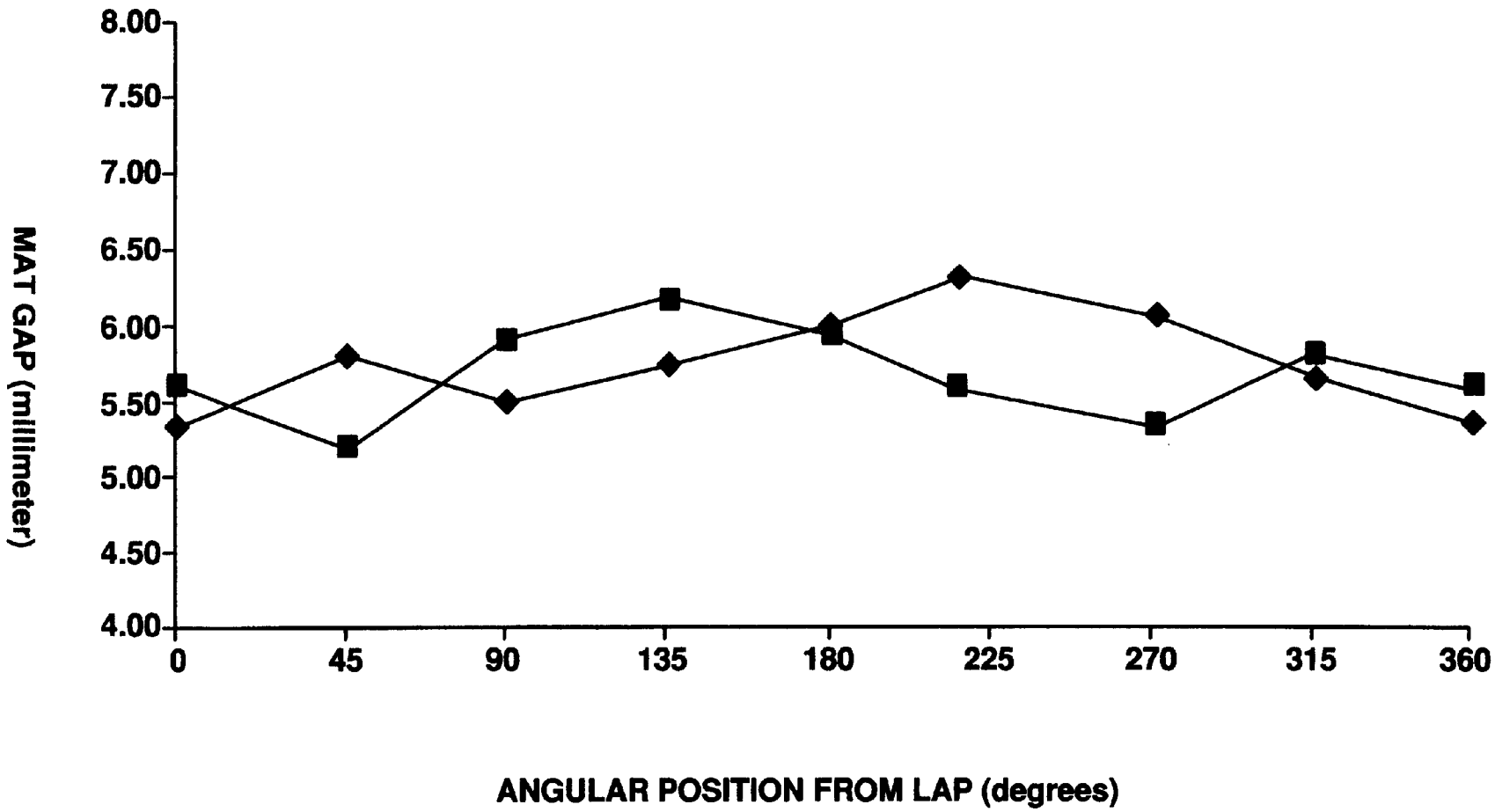
FIG. 9 is a graph illustrating a representative mat gap for a catalytic converter incorporating a round honeycomb substrate.

Examination of FIG. 9, which is representative of the typical mat gap variation, for canned round honeycomb substrates reveals a mat gap uniformity, and thus substrate compression which compares favorably to that obtained by the plugged oval example of above.

It is to be understood that the present invention is not limited to the embodiments described above, and that various changes and modifications may be effected therein by one skilled in the art without departing from the intended scope or spirit of the invention.

I claim:

1. A method of manufacturing a catalytic converter for purifying exhaust gases from an internal combustion engine, the converter having a monolithic ceramic substrate surrounded by a supporting mat, comprising the steps of:

wrapping a non-round monolithic ceramic substrate in a sufficient amount of the supporting mat material whereby the substrate peripheral surface is substantially covered;

inserting the wrapped substrate into a metal shell which substantially surrounds the wrapped substrate placing at least one force redistribution plug on the peripheral surface of the metal shell and compressively closing the metal shell around the substrate; and securing the metal shell to provide a gas tight seal and to hold the compressive stress.

2. The method of claim 1 wherein compressively closing of the catalytic converter involves exerting a substantially uniform compressive stress on the honeycomb substrate.

3. The method of claim 1 comprising an oval substrate and involving placing a force redistribution plugs on the each of the opposite surfaces of the metal shell located along the minor axis catalytic converter.

4. The method of claim 3 wherein the oval substrate exhibits an aspect ratio of greater than 1.05.

5. The method of claim 1 wherein the force redistribution plug is comprised of a deformable material selected from the group consisting of urethane, epoxy resin, neoprene and wood.

6. The method of claim 1 wherein the force redistribution plug is comprised of several layers of flat metal stock forming a leaf spring configuration.

7. The method of claim 1 involving a tourniquet wrap method of compressively closing the metal shell around the substrate.

8. The method of claim 1 involving a clam shell style method of compressively closing the metal shell around the substrate.

9. The method of claim 1 involving a collet closure method of compressively closing the metal shell around the substrate.

* * * * *